US005524405A

United States Patent [19]

Byrd

[11] Patent Number: 5,524,405

[45] Date of Patent: Jun. 11, 1996

[54] WALL STRUCTURE

[76] Inventor: Randall Byrd, P.O. Box 1550, Brookshire, Tex. 77423

[21] Appl. No.: 202,934

[22] Filed: Feb. 28, 1994

[51] Int. Cl.[6] ..... E02D 27/00; E04B 2/72

[52] U.S. Cl. ..... 52/295; 52/169.9; 52/293.1; 52/592.1; 256/19; 405/286

[58] Field of Search ..... 256/19; 52/477, 52/592.1, 592.2.592.3, 169.1, 169.2, 169.3, 169.4, 300, 761, 274, 295, 293.1, 293.2, 293.3, 270, 284, 169.9; 405/267, 274, 275, 276, 284, 286, 281

[56] References Cited

U.S. PATENT DOCUMENTS

| | | | |
|---|---|---|---|
| 791,775 | 6/1905 | Hansell | 52/293.3 |
| 829,397 | 8/1906 | Gerber | 256/19 |
| 1,467,470 | 9/1923 | Borg | 405/286 |
| 3,170,201 | 2/1965 | Nofziger | 256/19 |
| 3,334,455 | 8/1967 | Russell | 52/274 |
| 3,472,031 | 10/1969 | Kelso | 405/275 |
| 3,503,589 | 3/1970 | Moore | 405/284 |
| 3,512,759 | 5/1970 | Resler | 256/19 |
| 4,519,729 | 5/1985 | Clarke, Jr. et al. | 405/267 |
| 4,750,306 | 6/1988 | Granieri | 52/295 |
| 5,202,132 | 4/1993 | Myers et al. | 425/62 |

*Primary Examiner*—Michael Safavi
*Attorney, Agent, or Firm*—Keeling Law Firm

[57] ABSTRACT

A wall structure is disclosed comprising a plurality of wall modules, a wall module including a post integrally cast with an attached wall panel. A vertical channel is provided in a post side, the vertical channel receiving an end of an adjoining panel. A vertical orifice is provided in the post. A post support is provided to support each post, the support including an anchor. A bar inserted through the post orifice is threaded into the anchor. The bar is threaded at its upper end. A disk member is provided external of the bar near its upper end, the disk member resting on a post surface. A nut is threaded on the bar and tightened thereby inducing tension in the bar between the anchor and the disk member and fixedly attaching the post to the support.

19 Claims, 3 Drawing Sheets

WALL STRUCTURE

BACKGROUND OF THE INVENTION

1. Field of the Invention

The field of the invention relates to wall structures, and particularly to precast concrete wall structures for use as sound barriers, containment walls and like purposes.

2. Description of the Prior Art

Precast concrete walls are used for a variety of purposes, including noise abatement in areas where there exists high volume traffic adjacent to residential or commercial areas and including containment purposes. Concrete walls have been found to be desirable for noise abatement purposes due to the insulating characteristics, impact resistance and weathering characteristics of concrete. Concrete walls provide many of the advantages of earthen berms, but require substantially less space. Concrete walls are additionally desirable, for like reasons, for containment walls.

In some installations, such as applications involving concrete building walls, concrete wall modules are poured on site, tilted to an erect position and joined with other wall sections. It is often more economical, however, to cast wall modules offsite and transport the wall modules to the construction site.

Appropriate joining and support of concrete wall modules to withstand wind shear and impact stresses is necessary. It is further necessary to have the ability to adjust wall levels to account for varying terrain elevation.

Joining and support of concrete wall modules, as commercially practiced, typically involves casting columns in place and inserting precast wall modules between the columns. The columns extend into the earth to provide anchoring for the walls. The columns are typically provided with vertical channels, the vertical channels receiving ends of the wall panels. Precast wall sections are typically lifted with a crane to a position above the columns and lowered into the channels provided in the columns. As such walls are often constructed along highways near electrical power and telephone lines, it is often necessary that such utility lines be disconnected to accommodate construction of the walls. Wall sections may be relatively high, typically including height ranges of twelve feet to twenty feet. As such sections are raised above columns of like height, it is necessary to provide a crane having relatively high load capacity and boom length.

Smith, et al., U.S. Pat. No. 4,402,384 discloses a sound barrier system comprising a vertical wall composed of successive individual wall sections arranged with intermediate wall sections disposed at intersecting angles. Anchors are provided at each vertical joint, the anchors comprising screw-type augers in a preferred embodiment.

In recognition of limitations inherent in conventional concrete wall construction methods various wall systems providing noise abatement have been developed.

Gavel U.S. Pat. No. 4,146,113 discloses a noise protection screen comprising a plurality of hollow, interconnected members, the members inclined at an angle to the horizontal.

Reusser U.S. Pat. No. 4,306,631 discloses a noise barrier including spans extending between posts, the spans having interlocking elements.

Lerner, et al. U.S. Pat. No. 4,278,146 discloses a sound barrier comprising a series of sections separated by V-shaped ribs, with acoustical material contained in the cavities defined by the ribs.

It is an object of the present invention to provide a wall structure wherein the wall section and a support column are precast as an integral unit.

It is a further object of this invention to provide a wall structure wherein the wall sections may be installed without the necessity of lifting wall sections above columns.

It is a further object of this invention to provide a wall structure characterized by relatively quick and economical construction.

SUMMARY OF THE INVENTION

The foregoing and other objects of the present invention are accomplished by a wall structure comprising wall modules, each module including a post integrally constructed with a wall panel. A vertical channel is provided in a post side, the vertical channel receiving an end of an adjoining panel. A vertical orifice is provided in the post. A support is provided to support each post, the support including an anchor. A bar inserted through the post orifice is threaded into the anchor. The bar is threaded at its upper end. A disk member is provided external of the bar near its upper end, the disk member resting on a post surface. A nut is threaded on the bar and tightened, thereby inducing tension in the bar between the anchor and the disk member and fixedly attaching the post to the support.

DETAILED DESCRIPTION OF THE INVENTION

Figures 1, 3, 4:
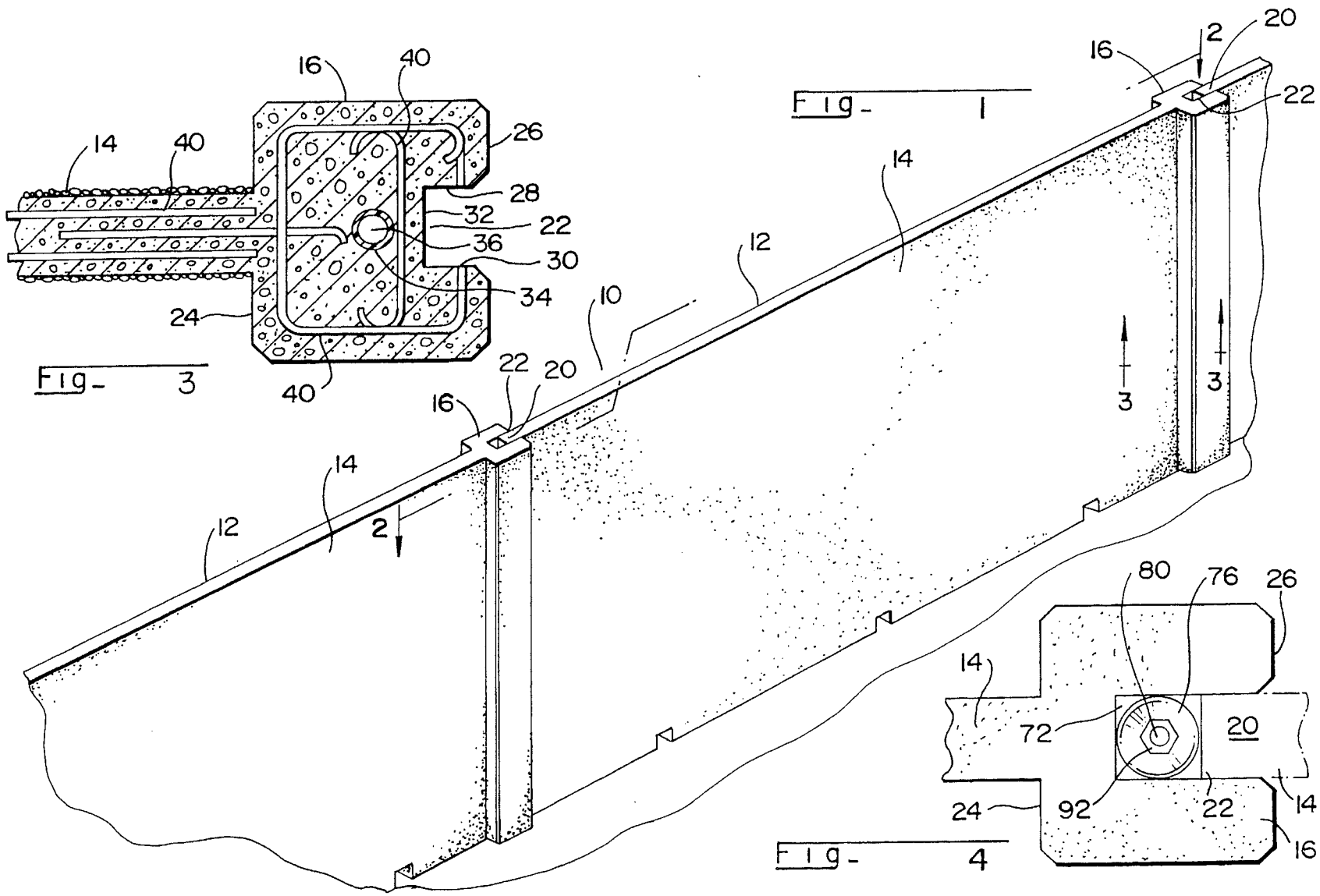
FIG. 1 depicts an isometric view of a wall section of the precast concrete wall of the present invention.
FIG. 3 depicts a cross-sectional view of a post and a portion of a panel of a wall module at line 3—3 of FIG. 1.
FIG. 4 depicts a plan view of a post and a portion of a panel of a wall module.

Referring to FIG. 1 an isometric view of a wall module 12 of a precast concrete wall 10 of the present invention is depicted. Wall module 12 includes a panel 14 and a post 16. Panel 14 comprises a generally rectangular wall-section. Post 16 is integrally formed with panel 14. End 20 of panel 14 extends into channel 22 of adjoining post 16. The precast concrete wall 10 of the present invention comprises a plurality of adjoining wall modules 12.

Referring now to FIG. 3, a cross-sectional view of post 16 and a portion of panel 14 at line 3—3 of FIG. 1 is depicted. In horizontal cross-section, post 16 has a generally rectangular configuration, panel 14 joining post 16 at the middle of post side 24. Post side 26, opposite post side 24, is provided with an inwardly-extending channel 22. Channel 22 includes wall 28 and wall 30 extending inwardly from post side 26 to channel bottom 32. Wall 28 and wall 30 are generally parallel and are spaced a distance slightly greater than the width of panel 14 at panel end 20 so that panel end 20 fits within channel 22. Channel bottom 32 is spaced from side wall 26 a distance approximating the width of panel 14 at end 20.

Still referring to FIG. 3, hollow pipe 34 is located centrally of post 16. Pipe 34 is depicted in cross-section in FIG. 3 as pipe 34 extends vertically within post 16. The inner surface of pipe 34 defines a vertically-extending cylindrical orifice 36 within post 16.

FIG. 3 depicts various sections of rebar 40 contained within post 16 and panel 14. Rebar 40 is regularly used in the construction of concrete wall panels and posts and is used in the post 16 and panel 14 of the present invention consistent with industry practice.

Figure 5:
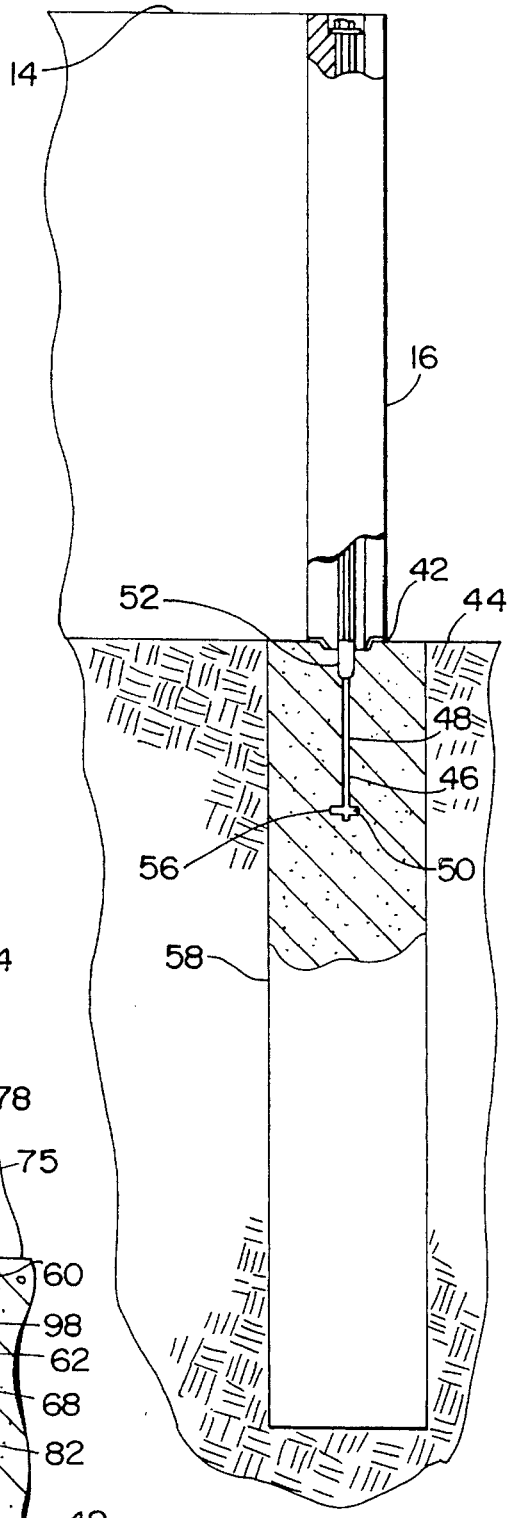
FIG. 5 depicts a partial cross-sectional side view of a post and panel at line 5—5 of FIG. 2.

Referring now to FIG. 5, post 16 and piling 42 are shown in partial cross-section. In the embodiment shown, piling 42 comprises a cylindrical block of concrete extending into the ground 44 formed by drilling a hole in the ground 44, inserting a caisson (not shown) and pouring concrete to fill the caisson. Anchor 46 is embedded in piling 42.

Anchor 46 includes a vertically-extending rod 48, an anchor flange 50, and a bar splicer 52. Rod 48 extends from the upper end of piling 42 downwardly into the piling 42. Flange 50 is fixedly attached to rod 48 at the lower end of rod 48. Flange 50 comprises a flat, cylindrical disk extending horizontally from rod 48, the outer edge 56 of flange 50 intermediate rod 48 and the outer edge 58 of piling 42.

A piling 42 with an anchor 46 is provided to support each post 16 of the precast concrete wall 10 of the present invention.

Figure 8:
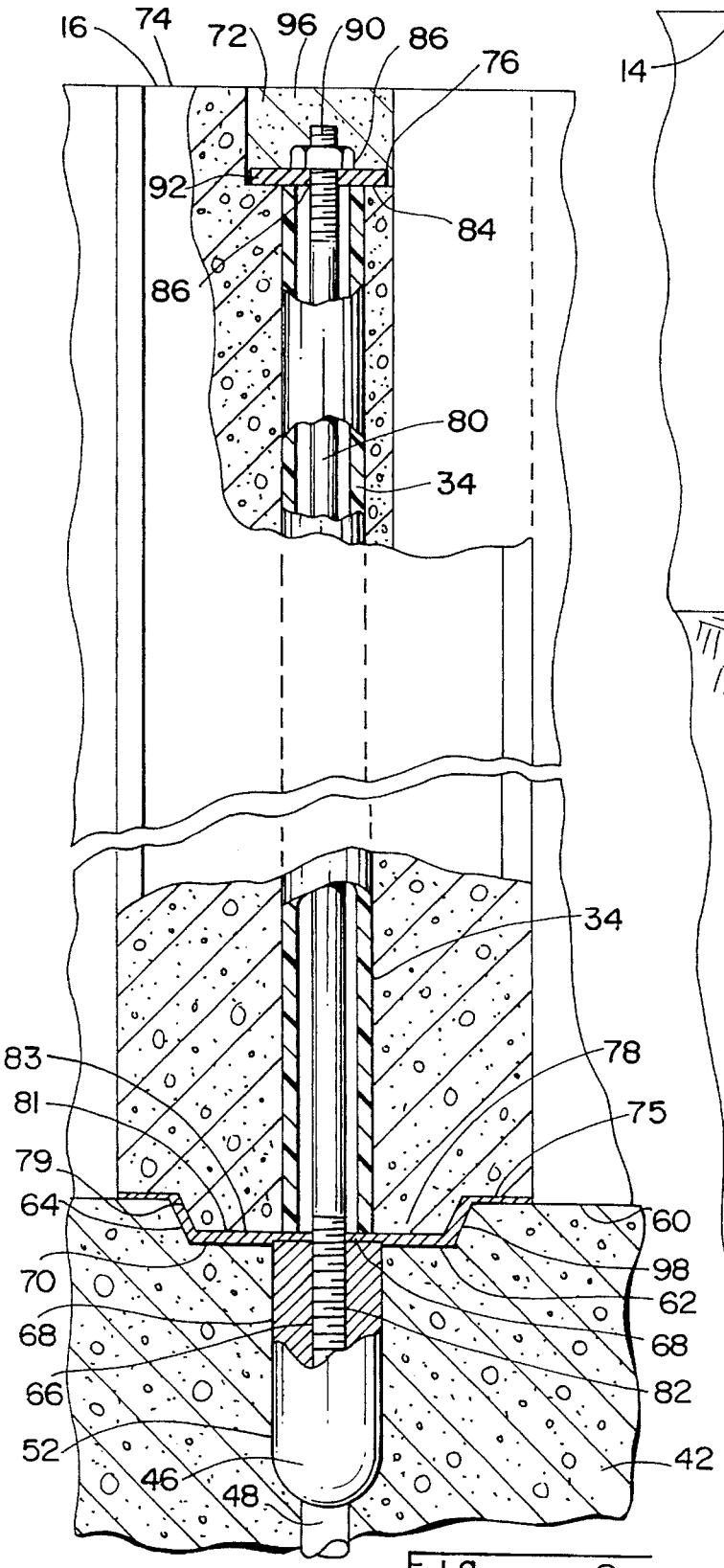
FIG. 8 depicts a partial cross-sectional side view of a piling.

Referring now to FIG. 8, further detail of the piling 42 and anchor 46 of the present invention is depicted. A centrally-located receiver 62 is provided in the upper surface 60 of piling 42. Receiver 62 comprises a generally-cylindrical recessed area in upper surface 60. Side wall 64 of receiver 62 is inclined outwardly.

Still referring to FIG. 8, the upper end 68 of bar splicer 52 is placed at the level of the bottom surface 70 of receiver 62. Bar splicer 52 comprises a generally cylindrical member fixedly attached to the upper end of rod 48, bar splicer 52 being wider than rod 48. Bar splicer 52 is provided with a centrally-located threaded orifice 66 at its upper end 68, the orifice 66 extending downwardly from upper end 68. Receiver 62 and anchor 46 are each located centrally of piling 42. Bar splicer 52 and receiver side wall 64 are concentric.

Post 16 is depicted in FIG. 8 in partial cross-section. Pipe 34 extends from a keyway 72 provided at the upper end 74 of post 16 to the lower end 75 of post 16. Keyway 72 has a generally horizontal lower surface 84. A bar 80 extends throughout pipe 34. Bar 80 extends vertically above surface 84 and below lower end 75 of pipe 16. Bar 80 is provided with threading at its lower end 82.

As installed and as shown in FIG. 8, lower end 82 of bar 80 extends into bar splicer 52 and is threadedly connected to female threading provided in orifice 66 of bar splicer 52.

Still referring to FIG. 8, keyway 72 comprises a generally cylindrical depression provided in the upper end 74 of post 16. A disk 76 is provided at the bottom 84 of keyway 72. Disk 76 comprises a generally cylindrical flat member. A central orifice 86 is provided in disk 76, the central orifice 86 being wider than bar 80. The upper end 90 of bar 80 is provided with external threading. Locking nut 92 is threadably engaged with the external threading of upper end 90. Locking nut 92 compresses disk 76 against surface 84.

Still referring to FIG. 8, grout 96 is depicted in keyway 72. Grout 96 is used to fill keyway 72 upon installation of the post 16 and wall module 12, thereby providing a finished external appearance and reducing the likelihood of tampering by unauthorized persons.

A lower end extension 78 extends downwardly from the lower end 75 of post 16. Lower end extension 78 is generally cylindrical and is sized and shaped so as to fit within receiver 62 provided in piling 42. Side wall 98 of extension 78 extends outwardly at an obtuse angle to the horizon, the angle of side wall 98 being generally equivalent to the angle of side wall 64 of receiver 62.

Extension 78 extends downwardly from lower end 75 a lesser distance than the depth of receiver 62. Extension 78 side wall 98 has a lesser circumference than side wall 64 of receiver 62. Upon placement of post 16 on piling 42 a cavity 81 is defined with lower end 75 and extension 78 defining the upper surface and receiver 62 defining the lower surface. Grout 83 is provided in the cavity 81.

Figure 7:
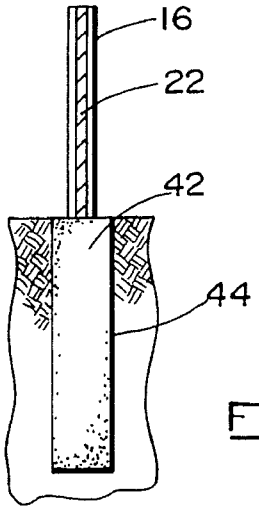
FIG. 7 depicts an end view of a post and piling.

Referring now to FIG. 7, an end view of post 16 and piling 42 is depicted. Piling 42 is embedded in ground 44. Channel 22 extends along the vertical length of post side 26.

Referring now to FIG. 4, a top view of the post 16 and a portion of wall panel 14 is depicted. Adjoining end 20 of adjoining wall panel 14 is depicted by broken lines in FIG. 4, said adjoining end 20 extending into channel 22 of post 16. Disk 76 is disposed within keyway 72. Nut 92 is threaded onto bar 80. Grout 96 is not depicted in FIG. 4, grout 96 being inserted in keyway 72 upon completion of installation of the wall module 12.

Figure 6:
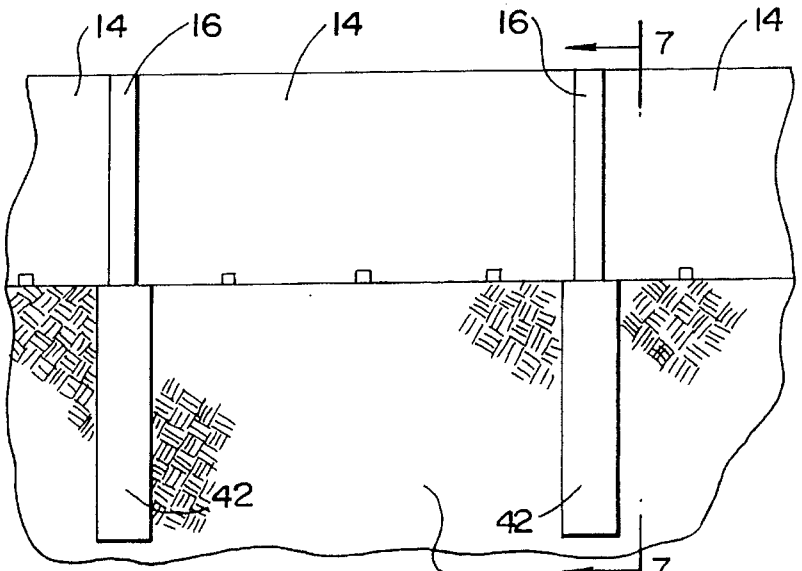
FIG. 6 depicts an elevational view of a wall section of the precast concrete wall of the present invention.

Referring now to FIG. 6, an elevation view of the precast concrete wall 10 of the present invention is depicted. Two posts 16 are depicted, each post 16 supported on a corresponding piling 42. Each wall panel 14 extends from a post 16 with which it is formed to a second post 16, the end 20 (not shown in FIG. 6) extending into channel 22 (not shown in FIG. 6).

Figure 2:
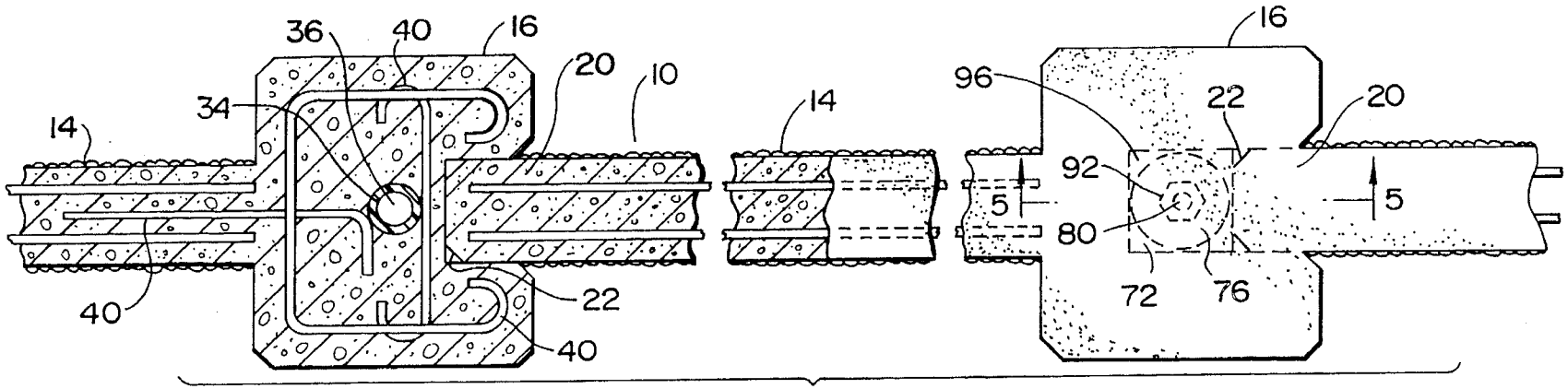
FIG. 2 depicts a partial cross-sectional, plan view of a wall section of the concrete wall of the present invention.

Referring now to FIG. 2, a partial cross-sectional top view of the precast concrete wall 10 of the present invention is depicted. Two posts 16 are depicted with a wall panel 14 extending from the post 16 with which it is formed to a second post 16, the wall panel end 20 extending into the channel 22 of the second post 16. The upper end of pipe 34 is depicted in the second post 16. Various sections of rebar 40 are depicted. The circular disk 76 (broken line) is disposed within keyway 72. Nut 92 (broken line) is threaded onto bar 80 (broken line). Grout 96 is placed in keyway 72.

Operation

Referring first to FIGS. 1 and 2, in the preferred embodiment of the present invention, the wall modules 12 of the present invention are precast with the wall panel 14 and the post 16 cast as an integral unit. The wall modules 12 may be cast at a remote location and transported to the site of erection of the wall structure 10.

Referring now to FIGS. 5 and 8, piling 42 is installed in ground 44. A plurality of pilings 42 may be installed prior to delivery of the wall modules 42 to the erection site to facilitate rapid erection of the concrete wall structure 10. Anchor 46 is embedded in piling 42 with the upper end 68 of bar splicer 52 at the bottom surface 70 of the receiver 62.

Post 16 of wall module 12 is first placed slightly above the piling 42. Blocks 9 (not shown) may be used to temporarily support the wall module 12. Bar 80 is then inserted through the orifice 36. The lower end 82 of bar 80 is threaded into orifice 66 of bar splicer 52 and tightened. Grout 83 is placed in receiver 62.

Wall module 12 is then lowered onto piling 42. Cooperative engagement of extension 78 into receiver 62 facilitates desired placement of post 16 on piling 42.

Disk member 76 is placed on surface 84. Nut 92 is inserted on upper end 90 of bar 80 and tightened against disk member 76 until tension is induced in bar 80 between anchor 46 and disk member 76. The wall module 12 is thereby fixedly retained on piling 42 in an upright position. Grout 96 may then be inserted in keyway 72.

After appropriate cure time, grout 83 additionally serves to retain the wall module 12 in a fixed upright position.

Adjoining wall module 12 is installed in a like manner, it being recognized that end 20 of adjoining wall 14 is inserted in channel 20 of post 16.

The preferred embodiment depicted shows channel 22 in a side 26 of post 16 opposite side 24 to which wall panel 14 is attached.

It would be apparent to one skilled in the art that variations in location and orientation of channel 22 within post 16 may be made to accommodate angular extension of an adjoining wall panel 14. It would also be apparent that appropriate modification to the wall module 12 may be made to accommodate end posts and other deviations from the specific disclosure depicted.

It would be apparent to one skilled in the art that the wall modules 14 may be constructed in vertically stacked sections to achieve additional height of the wall structure. In such an embodiment, the bar 80 extends from an upper surface 84 of an upper wall module section post 16 through an orifice 36 in the upper section post 16, through an orifice 36 in the lower section post 16 and engaging anchor 46 in piling 42.

The preferred embodiment depicted and described contemplates construction of the wall modules from reinforced concrete. It would be apparent to one skilled in the art that the wall modules 12 and support (piling 42 in the preferred embodiment) could be constructed of another material without departing from the spirit of the invention.

While this invention has been described with special emphasis on a single preferred embodiment, it should be understood that within the scope of the appended claims the invention may be practiced otherwise than as specifically described.

I claim:

1. A wall module comprising:

a wall panel having a first end connected to a vertically extending post and having a distal second end;

said post supported on a post support;

said post attached to said post support by post attachment means;

said post integrally connected to said wall panel along a first post side;

said post integrally formed with said wall panel;

whereby said post and said wall panel form a unitary construction and comprise a single body;

said post having a vertically extending channel along a second post side;

said channel sized to receive a wall panel second end of a like-constructed, adjoining wall module;

said post attachment means including tension means, said tension means operatively connected to said post and said post support;

whereby a lower surface of said post may be compressed against an upper surface of said post support by said tension means; and whereby said post is fixedly attached to said post support by said post attachment means and said wall module is interconnectable with said like-constructed, adjoining wall module by insertion of said wall module panel second end of said like-constructed, adjoining wall module in said channel.

2. The structure according to claim 1, further comprising:

said wall panel and said post constructed of concrete;

said wall panel and said post transportable from a first casting location to a second wall erection location.

3. The structure according to claim 1, further comprising:

said post attachment means including an anchor attached to said post support; and said post attachment means further including at least one elongated member operatively engaging said anchor and said post.

4. The structure according to claim 3, further comprising:

said at least one elongated member having a lower end and an upper end;

said at least one elongated member attached to said anchor at said lower end and said at least one elongated member operatively engaging said post at said upper end;

adjustment means for adjustably attaching said at least one elongated member to at least one of said anchor and said post;

said adjustment means inducing tension in said at least one elongated member.

5. The structure according to claim 4, further comprising:

at least one vertically extending orifice provided in said post;

said at least one elongated member extending through said at least one vertically extending orifice.

6. The structure according to claim 4, further comprising:

said at least one elongated member comprising at least one bar;

said at least one bar having exterior threading at its upper end;

at least one nut having internal threading cooperatively engaging said at least one bar upper end threading;

a lower surface of said at least one nut engaging a post surface;

said at least one nut threadedly adjustable to induce tensile stress on said at least one bar between said anchor and said at least one bar upper end.

7. The structure according to claim 6, further comprising:

at least one disk member extending exterior of said at least one bar upper end;

said at least one disk member supportable on a post surface;

said at least one disk member positioned between said nut and said post surface;

whereby said post is secured against said post support by connecting and tightening said at least one nut against said at least one disk, said at least one bar in tension between said at least one disk and said support anchor member.

8. The structure according to claim 5, further comprising:

said post support upper surface including a recessed area;

said post lower surface including an extended area;

said extended area receivable in said recessed area;

adhesive means provided in said recessed area, said adhesive means joining said post support and said post extended area.

9. The structure according to claim 8, further comprising:

said wall panel and said post comprising integrally cast reinforced concrete;

said adhesive means comprising grout;

said wall panel and said post transportable as an integral wall unit from a first casting location to a second wall erection location.

10. A wall module comprising:

a wall panel having a first end integrally connected to a vertically extending post and having a distal second end;

said wall panel and said post integrally formed;

whereby said post and said wall panel form a unitary construction and comprise a single body;

said post supported on a post support;

said post connected to said wall panel along a first post side;

said post having a vertically extending channel along a second post side;

said channel sized to receive a wall panel second end of a like-constructed, adjoining wall module;

said wall module is interconnectable with said like-constructed, adjoining wall module by insertion of said wall module panel second end of said like-constructed, adjoining wall module in said channel;

said post attached to said post support by post attachment means;

said post attachment means including an anchor attached to said post support and at least one elongated member;

said at least one elongated member having a lower end and an upper end;

said at least one elongated member attached to said anchor at said lower end and said at least one elongated member operatively engaging said post at said upper end;

adjustment means for adjustably attaching said at least one elongated member to at least one of said anchor and said post;

said adjustment means inducing tension in said at least one elongated member;

whereby said post is at least partly secured on said post support by said tension in said at least one elongated member.

11. The structure according to claim 10 further comprising:

said wall panel and said post constructed of reinforced concrete;

said wall panel and said post transportable from a first casting location to a second wall erection location.

12. The structure according to claim 11, further comprising:

at least one vertically extending orifice provided in said post;

said at least one elongated member extending through said at least one vertically extending orifice.

13. The structure according to claim 12, further comprising:

said at least one elongated member comprising at least one bar;

said at least one bar having exterior threading at its upper end;

at least one nut having internal threading cooperatively engaging said upper end external threading;

a lower surface of said at least one nut engaging a post surface;

said at least one nut threadedly adjustable to induce tensile stress on said at least one bar between said anchor and said at least one bar upper end.

14. The structure according to claim 13, further comprising:

a disk member extending exterior of said at least one bar upper end;

said disk member supportable on a post surface;

said disk member positioned between said nut and said post surface;

whereby said post is secured against said post support by connecting and tightening said nut against said disk member, said bar in tension between said disk and said support anchor member.

15. The structure according to claim 14, further comprising:

said post support upper surface including a recessed area;

said post lower surface including an extended area;

said extended area receivable in said recessed area;

adhesive means provided in said recessed area, said adhesive means joining said post support and said post extended area.

16. A structure according to claim 12, further comprising:

said wall module comprising at least two wall module sections, an upper wall module section supported on a lower wall module section.

17. A wall module comprising:

a wall panel having a first end connected to a vertically extending post and having a distal second end;

said post supported on a post support;

said post connected to said wall panel along a first post side;

said post having a vertically extending channel along a second post side;

said channel sized to receive a wall panel second end of a like-constructed, adjoining wall module;

said post support including an anchor;

a bar having a lower end and an upper end;

said bar attached to said anchor at said lower end;

said upper end having an external thread;

a nut threadedly engaging said upper end;

a vertically extending orifice provided in said post;

a generally horizontal post upper surface;

said bar extending through said orifice above said post upper surface;

a disk member supported on said post upper surface;

said nut adjustable on said bar upper end to engage said disk member exerting tension on said bar between said anchor and said disk member;

whereby, said post is secured in an upright position on said post support by tightening said nut against said disk, said bar in tension between said disk and said anchor.

18. The structure according to claim 17, further comprising:

said wall module constructed of reinforced, precast concrete;

said post support upper surface including a recessed area, said recessed area having at least one side wall extending angularly outward;

said post lower surface including an extended area;

said extended area receivable in said recessed area;

grout provided in said recessed area intermediate said lower surface extended area and said recessed area.

19. The structure according to claim 18, further comprising:

said wall module comprising at least two wall module sections, an upper wall module section supported on a lower wall module section.

* * * * *